United States Patent [19]

Hasslen, III

[11] Patent Number: 4,992,030

[45] Date of Patent: Feb. 12, 1991

[54] SUMP DRAINING APPARATUS

[76] Inventor: John S. Hasslen, III, 1033 Manor Pl., Elk River, Minn. 55330

[21] Appl. No.: 521,257

[22] Filed: May 9, 1990

Related U.S. Application Data

[63] Continuation-in-part of Ser. No. 346,396, May 2, 1989.

[51] Int. Cl.[5] ..... F04B 35/04

[52] U.S. Cl. ..... 417/360; 417/423.15

[58] Field of Search ..... 417/360, 361, 423.15, 417/423.3, 572

[56] References Cited

U.S. PATENT DOCUMENTS 2,853,950 9/1958 Lovell ..... 417/423.15 X

*Primary Examiner*—John C. Fox

*Attorney, Agent, or Firm*—Merchant, Gould, Smith, Edell, Welter & Schmidt

[57] ABSTRACT

A sump draining apparatus is disclosed which is intended for use in removing toxic and other hazardous liquids from sites such as landfills. The sump draining apparatus is intended for use in a landfill or the like having a side slope riser conduit that extends from the bottom of the landfill along its sloping side surface to a point outside the landfill. The apparatus includes a cylindrical body that is smaller in size than the riser conduit and which houses an electric pump that discharges fluid through a flexible pipe connected to the apparatus outlet and which extends through the riser conduit to a point outside the landfill. The cylindrical body is provided with a wheel assembly at each end that together permit it to roll to the extreme bottom of the side slope riser conduit where it may pump with maximum effectiveness.

11 Claims, 4 Drawing Sheets

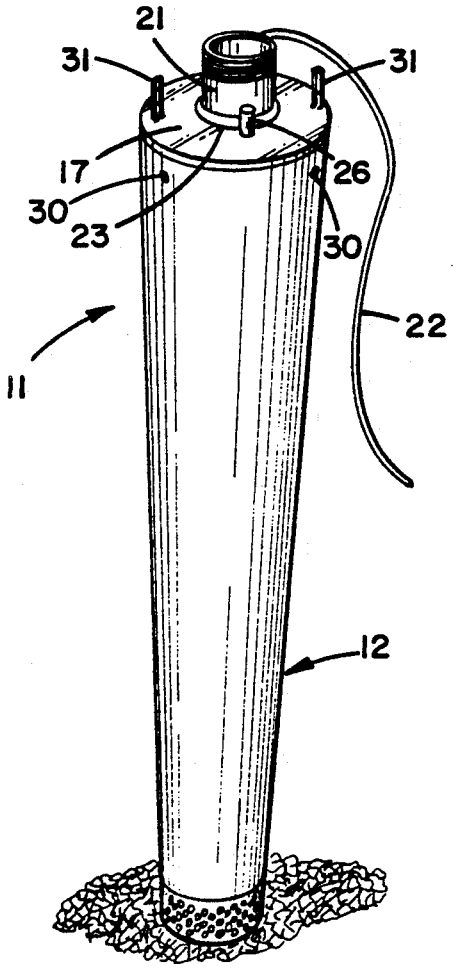
FIG. 1
FIG. 2
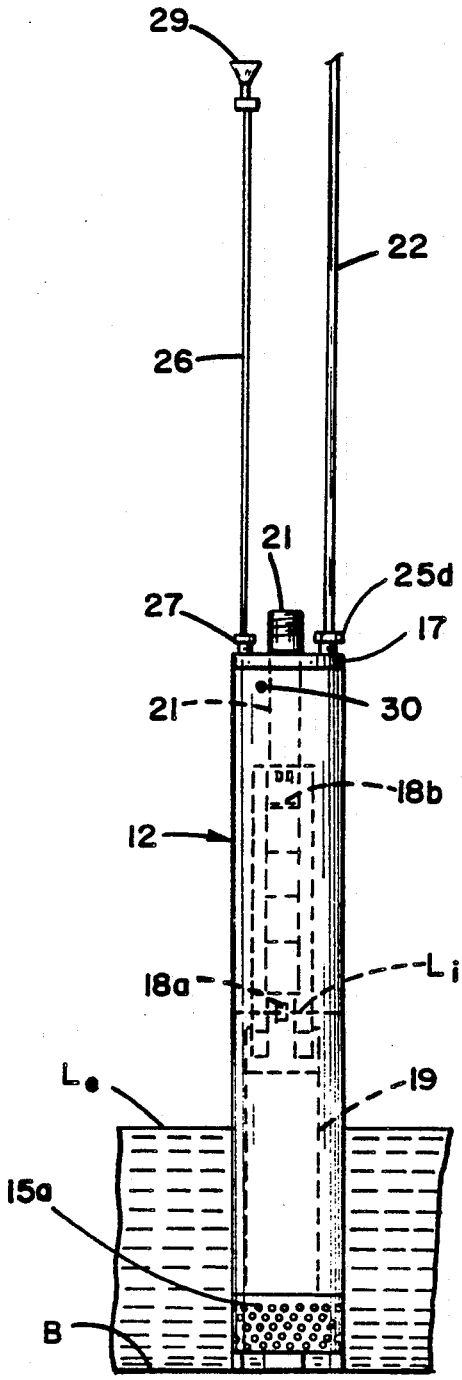

SUMP DRAINING APPARATUS

This is a continuation-in-part of my copending application Ser. No. 07/346,396 filed May 2, 1989 and entitled "Sump Draining Apparatus".

BACKGROUND OF THE INVENTION

This invention broadly relates to pumping apparatus and is specifically directed to sump draining apparatus capable of removing hazardous or toxic liquid from spill areas, landfills, leachate sumps, recovery wells and the like.

The presence of toxic and hazardous waste material represents a problem of increasing concern, particularly where such material is found beneath the surface of the ground. The presence of toxic and hazardous liquids in subsurface environments is particularly acute because of the possibility of leaching into water supplies and causing irreparable harm to natural environments.

In some cases, toxic and hazardous liquid waste is created by a particular environment and simply must be controlled by ongoing removal. In others, the liquid waste material finds its way into an environment in which it should not exist, and it must be removed to prevent the problem from spreading as well as to return the environment to its normal state.

An example of the first type of problem is the conventional landfill. Landfills that comply with environmental protection and pollution control regulations consist of a large ground recess the bottom and sides of which are lined with a liquid impermeable material to contain the waste as it is dumped into the recess. An ongoing problem, however, it the seepage of liquid to the bottom of the landfill, which may be waste material in liquid form or simply rain water that seeps through waste in more solid form. If the impermeable liner is punctured or ruptures, the liquid waste flows away from the landfill and creates a toxic or otherwise hazardous environment.

An example of the second type of problem mentioned above is the hydrocarbon spill from gasoline holding tanks at filling stations. These holding tanks are typically installed below the ground, and leaks developed in the tank or in the tank fittings create problems that are not only of a toxic nature but extremely hazardous as well. While it was once believed that such problems exist only in a small percentage of gasoline holding tanks, it is now being found that such problems are relatively commonplace.

Conventional sump draining devices are capable of efficiently removing some types of liquid in certain environments. However, some hazardous and toxic liquids and certain environments cause conventional sump draining apparatus to operate in a less than satisfactory manner.

As an example, conventional devices capable of efficiently removing liquid from larger sump sites are themselves relatively large, particularly in transverse dimension. While size is not necessarily a problem in a purely liquid environment, it becomes a significant problem for environments such as landfills, which include a significant amount of solid waste. It maybe necessary to install the sump draining apparatus to depths of up to 100 feet to remove the drained liquid, and installing such a device after the landfill is full or partially full is extremely difficult when larger pumping devices are used.

The relatively large size of conventional sump draining apparatus also makes them relatively expensive, particularly where multiple devices are necessary for large sump pits such as landfills.

Another problem with conventional sump draining devices is that they are typically designed to pump water, but not corrosive liquids or liquids which are flammable (e.g., gasoline). In a highly corrosive environment, conventional devices may lose efficiency relatively quickly, followed by a total breakdown. This problem is compounded when the pumping device is located at significant depths and cannot be easily replaced or repaired.

It is possible to overcome the corrosion problem with a stainless steel pump. However, pumps of this type have not been effectively incorporated into sump draining apparatus for use in environments such as landfills and other leachate sumps. Further, some conventional stainless steel pumps have pump inlets that are located at a point remote from the bottom of the pump, which structurally prevents the pump from being positioned at the extreme bottom of the sump pit as is necessary to remove substantially all the liquid.

A different problem is encountered in landfills that utilize a side slope riser conduit for the removal of hazardous and/or toxic liquid from a landfill. The side slope riser conduit typically consists of a length of pipe ranging from six inches to two feet in diameter, and which extends from a point outside the landfill along its sloping side surface to the extreme bottom of the landfill. The side slope riser conduit is closed at its extreme lower end, but perforated to permit the flow of leachate into the conduit at the lower end. A sump draining apparatus is installed in the conduit at its extreme lower end and is positioned to pump the liquid entering the lower end through an exhaust line projecting through the conduit to its upper end.

Conventional sump draining apparatus present a number of difficulties in the side slope riser conduit application, not the least of which is installing the apparatus. The conventional approach has been to place the sump draining apparatus on a type of skid that slides by gravity along the slope of the riser conduit, which typically has a slope of 3/1. To operate properly, the sump draining apparatus must be positioned at the extreme bottom end of the riser conduit, or it will not be in a position to be submerged into the leachate. Several problems have been encountered in such installations.

First, the sump draining apparatus must of necessity include an exhaust line connected to its outlet, which must be flexible to follow any bends in the riser conduit. Because the slope of the riser conduit is not extreme, the sump draining apparatus must be force fed along the conduit to its bottom. However, the flexibility of the outlet line does not permit it to be used to push the sump draining apparatus into place, and the deeper the sump draining apparatus travels into the riser conduit, the more difficult it is to force it farther. Skids have been employed in an effort to slide the sump draining apparatus to the bottom of the riser conduit, but with limited success. The slope of the riser conduit is often so shallow that friction between the skid and conduit causes the apparatus to come to a stop far short of the extreme lower end of the conduit. Further, skids increase the effective cross-sectional size of the sump draining apparatus, which makes movement of the apparatus difficult if not impossible when it encounters more than a gentle bend in the conduit.

Further, side slope riser conduits typically consist of a long straight section following the slope of the landfill side and terminating in a relatively short horizontal section that disposed at an angle relative to the longer section. The joint between the longer and short horizontal sections may create an angular bend that the sump draining apparatus cannot negotiate as discussed above. In addition, however, the two sections are conventionally joined with a thermal weld, which may include an internal bead that the skid cannot pass over.

All of the foregoing problems can prevent the sump draining apparatus from reaching its destination at the extreme lower end of the conduit if the apparatus is improperly positioned and it cannot operate properly. The problem is compounded by the fact that, without the utilization of expensive sensors, it cannot be determined when the sump draining apparatus reaches its destination.

Yet another problem encountered in the side slope riser conduit installation is misorientation of the sump draining apparatus when it reaches its destination. Preferably, the sump draining apparatus includes sensors used as limit controls to automatically start the sump pump in the presence of liquid, and to turn the pump off when the liquid level has diminished. These limit control sensors are sometimes mounted on the side of the sump draining apparatus, necessitating a specific orientation of the apparatus in order for them to operate properly. If misoriented, the automatic on-off control does not work properly.

SUMMARY OF THE INVENTION

This invention is directed to sump draining apparatus that overcomes the foregoing problems. To overcome problems encountered with corrosive and flammable liquids, the device utilizes a conventional stainless steel pump. The pump is elongated in configuration but has a relatively small transverse dimension, with the pump inlet intermediate its ends.

The problem of excessive size described above is overcome by utilizing the small transverse dimension of the pump advantageously, and de-emphasizing its longitudinal dimension. This is accomplished by positioning the stainless steel pump [longitudinally] in an elongated housing or canister of smaller transverse dimension, preferably cylindrical, which defines an internal chamber large enough to receive the pump and permit liquid waste to flow to its inlet, which is internally disposed at a midpoint within the chamber. The upper portion of the canister is sealably closed, and the lowest portion or bottom of the canister defines an inlet to permit the entry of liquid.

In the preferred embodiment, the canister is an elongated cylindrical steel tubular member, relatively small in diameter, and closed at both ends. To permit the entry of liquid into the canister, perforations are formed through the tubular side wall at its extreme lower end. Such perforations act to screen the liquid and to prevent the entry of larger particulate matter.

In the preferred embodiment, the submersible pumping means it self consists of a cylindrically shaped pump and motor disposed in stacked axial relation to permit slidable insertion into the tubular member, with the pump inlet at a midpoint thereon. The pump outlet is at the upper axial end of the pump, and a pipe leads from this outlet through the sealed top end off the canister to provide an external outlet to which a pipe or tube may be connected to discharge the pumped liquid to a remote location. To permit trapped air to be exhausted from the internal chamber of the canister, a vent outlet is provided in the top sealed end of the canister, to which a check valve vent to operably connected. This check valve may be mounted directly on the canister, or it may be remotely disposed through the use of a length of tubing connected between the vent outlet and the check valve.

With the bottom end of the canister placed at the extreme bottom of the sump pit, liquid enters through the side wall perforations at the bottom of the canister. To the extent the level of liquid is above these perforated openings, atmospheric pressure acting on the liquid forces it into the canister and causes it to rise at least to the level of the pump inlet, where it enters and is pumped out through the external pipe to a remote location. When liquid initially enters the canister, air is trapped within the internal chamber and compressed as the liquid level moves upward. The check valve vent enables this compressed air to be evacuated from the internal chamber.

So long as the liquid level in the sump pit is above the canister inlet, atmospheric pressure will continue to force the liquid upwardly to the pump inlet. As soon as the pump has completed its task of reducing the level of the liquid below the canister inlet, air enters the canister and liquid pumping stops. The pumping resumes as soon as the liquid accumulates above the canister inlet and is forced by atmospheric pressure up to the pump inlet.

The inventive sump draining apparatus is normally installed in a vertical position, but it may also be installed on its side with the sealed end slightly higher than the inlet end to remove maximum liquid from the sump pit. Because it utilizes a cylindrical pump disposed in a tubular member of relatively small diameter, it can be installed relatively easily even at significant depths by conventional well drilling. Utilizing corrosion resistant materials enables the inventive device to operate efficiently for extended periods of time in different environments.

The problems encountered in the side slope riser conduit application as described above are easily solved with an alternative embodiment of the inventive sump draining apparatus. More specifically, a multiple wheel configuration is mounted at each end of the cylindrical canister. Each wheel defines a rolling surface that projects radially outward of the canister surface, and the rolling surfaces therefor lie on a circumference that is greater than that of the canister. As such, the sump draining apparatus can roll longitudinally through the side slope riser conduit by gravity and without the canister side engaging the riser conduit side. Further, such longitudinal rolling movement takes place notwithstanding the rotational orientation of the canister. As such, the sump draining apparatus is easily lowered into place and stops only when it reaches the intended destination at the extreme lower end of the riser conduit.

In addition, the alternative embodiment includes a pressure transducer in the form of a drain gauge that is disposed at the lower or inlet end of the canister on its cylindrical axis. The pressure transducer senses increasing pressure in the presence of water and the lessening of pressure in the absence of water, thus enabling automatic control of the pump. Because the pressure transducer is located on the axis of the canister, it senses pressure properly notwithstanding the rotational orientation of a canister.

BRIEF DESCRIPTION OF THE DRAWINGS

FIG. 1 is a perspective view of a sump draining apparatus embodying the invention;

FIG. 2 is a view in side elevation of the sump draining apparatus with internal portions represented by phantom lines;

DETAILED DESCRIPTION OF THE PREFERRED EMBODIMENT(S)

Figure 3:
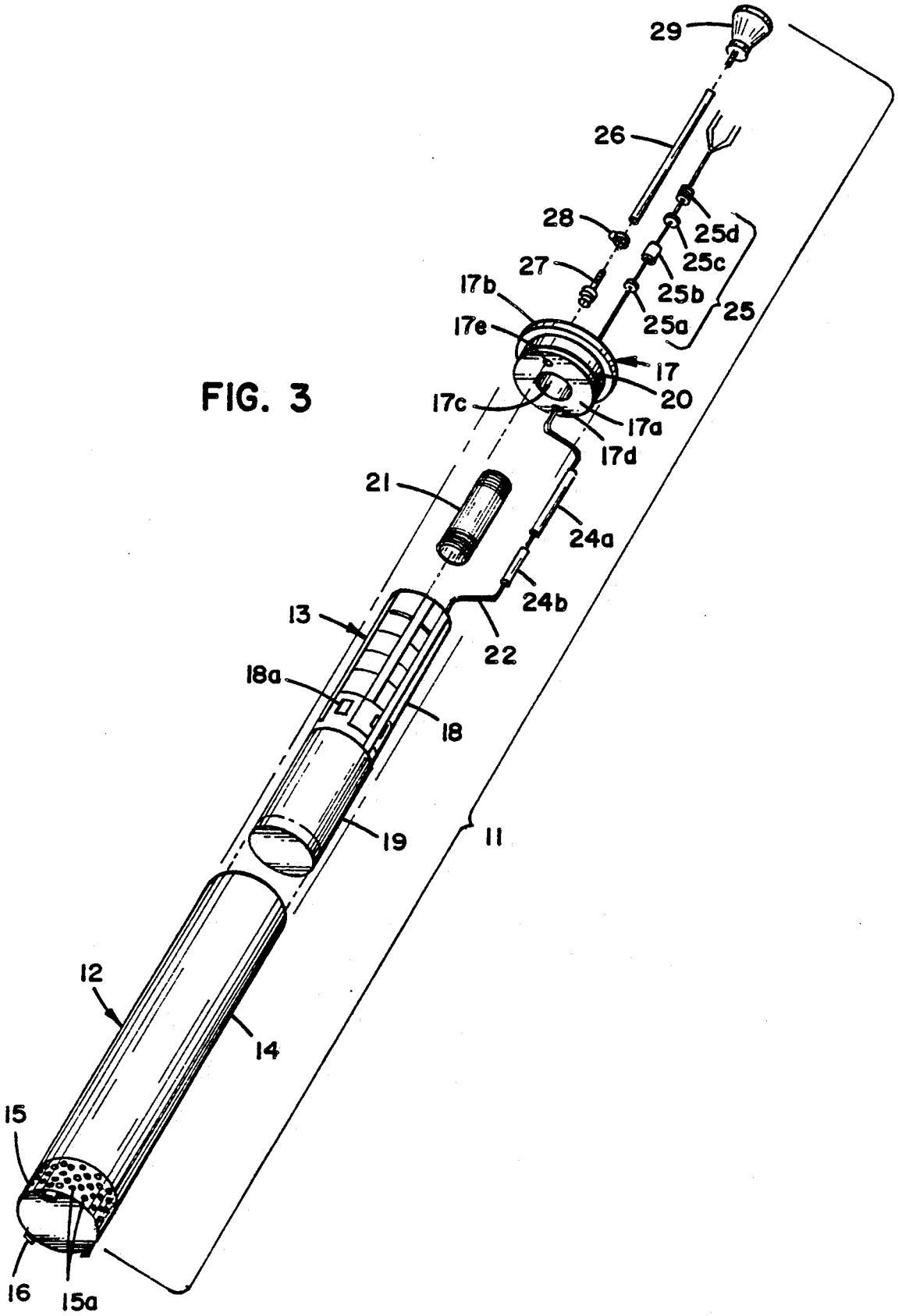
FIG. 3 is an exploded perspective view of the sump draining apparatus.

With reference to the figures, a sump draining apparatus is represented generally by the numeral 11. Apparatus 11 includes an external container or canister 12 that houses a pumping means 13 and other associated components described in further detail below.

Canister 12 is cylindrical in shape in the preferred embodiment, the primary component of which is an imperforate tubular member 14. The tubular member is preferably stainless steel, but it may be formed from corrosion resistant materials such as plastic or fiberglass. Tubular member 14 has a lower end 15 including perforations 15*a* that permit the entry of filtered liquid into the canister 12. The lower axial end of tubular member 14 is closed in the preferred embodiment, but for certain liquids and environments it could be open to permit the direct axial entry of liquid into canister 12.

In the preferred embodiment, the lower end 15 includes three equiangularly spaced supporting legs 16.

As an alternative to the perforations 15*a* in the lower end 15, the canister 12 may include a rigid cylindrical section of wire mesh or screen that performs the same function of permitting the lateral entry of filtered liquid into the canister 12.

The upper end of canister 12 includes a sealing plug 17 having a lower cylindrical projecting portion 17*a* sized to frictionally fit into the upper open end of tubular member 14, and a flange portion 17*b* that rests on the upper axial end of tubular member 14. It is intended that the sealing plug 17 be secured to the canister 12 to prevent the entry of liquid into the canister 12 from the top end. To that end, an O-ring 20 encircling the projecting portion 17*a* acts as a seal with the upper end of tubular member 14, and a plurality of mounting bolts (FIG. 1) extend through the side wall of tubular member 14 and into the projecting portion 17*a* to sealably clamp the plug 17 into place.

The pumping means 13 is also of cylindrical configuration and sized to fit into and be supported by the canister 12. Pumping means 13 is a commercially available electric submersion pump, an example of which is EPG Companies, Model TSP-1-5. This model is constructed of stainless steel to inhibit rust and corrosion. The output flow of such pumping means is 1.25–900 gallons per minute, depending on the pump size motor (power) with which it is equipped.

The pumping means 13 specifically comprises a cylindrically configured pump 18 and an electric pumping motor 19 arranged in axially stacked relation. The pump 18 includes a side inlet 18*a* that is disposed near its bottom end (FIGS. 2 and 3), but which is at an intermediate point with the pump 18 and motor 19 in stacked relation. Pump 18 also includes a top axial discharge outlet 18*b* (FIG. 2). The outlet 18*b* in the preferred embodiment is one to five inches in diameter and is threaded to receive a commensurately sized discharge pipe 21.

Electric pumping motor 19 is of the submergible type and is intended to operate in and below the surface of a liquid environment. An electrical conductor 22 leads from the motor 19 and from the top of the pump 18 for connection to a source of electrical power as discussed in further detail below.

With reference to FIG. 3, sealing plug 17 includes an axial bore 17*c* that is sized to receive the discharge pipe 21. As shown in FIGS. 1 and 2, discharge pipe 21 projects through the bore 17 above the canister 12, and is thus adapted for connection to a conduit for discharging the pump liquid to a remote location. Discharge pipe 21 is sealably connected to the sealing plug 17. This is accomplished by welding in the preferred embodiment (see reference numeral 23 in FIG. 1), although other sealing means may be employed.

The electrical conductor 22 must also be sealed to the plug 17, and to that end includes lengths of heat shrinkable tubular sealing material 24*a*, 24*b*. The shorter length 24*b* is placed over the conductor 22, and the longer length 24*a* slides over the shorter length 24*b*.

A small bore 17*d* formed through sealing plug 17 (FIG. 3) is sized to permit electrical conductor 22 and the lengths 24*a*, 24*b* to project therethrough. In the preferred embodiment, the bore 17*d* is threaded on the outlet side, and an assembly 25 consisting of a gland washer 25*a*, a rubber grommet 25*b*, a second gland washer 25*c* and a gland nut 25*d* serves to seal and clamp the conductor 22 and lengths 24*a*, 24*b* to the sealing plug 17 as well as to provide a strain relief function. The electrical conductor 22 is of sufficient length as to permit remote connection to a source of electrical power in a dry and noncorrosive environment.

Diametrically opposite the bore 17*d* in sealing plug 17 is a similar bore 17*e* that is adapted to receive a vent tube 26. In the preferred embodiment, a barbed connected 27 is threaded into the outlet side of bore 17*e*, and a tube clamp 28 secures the tubing 26 to the connector 27. Other sealed connectors may be used. A vent or relief check valve 29 is sealable secured to the vent tube 26. The check valve 29 may be disposed immediately adjacent the seal plug 17, or it may be located remote from the apparatus 11 through a vent tube 26 of desired length.

In the preferred embodiment, a pair of diametrically opposed lifting hooks 31 (FIG. 1) are secured to the top side of sealing plugs 17 to permit the apparatus 11 to be transported and lowered into place.

When the apparatus 11 is assembled as described hereinabove, the upper end of canister 12 is sealed in its entirety at the sealing plug 17, barbed connected 27, gland nut 25*d* and discharge pipe 21. As such, liquid cannot enter the canister 12 from the upper end of the apparatus 11 even if the entire apparatus is submerged in liquid. All liquid enters the apparatus from the lower end 15, either through the perforations 15*a* (or their equivalent if a screen or wire mesh is used) or through the axial opening of lower end 15.

Installation and operation of the apparatus 11 is specially shown in FIG. 2. In the vertical installation as shown, the canister 12 rests on the bottom B of a tank, reservoir or sump pit having a volume of liquid to be removed, which is at an external liquid level $L_e$ may be at various levels relative to the height of the apparatus 11, including total submergence of the apparatus 11. When installed properly, the electrical conductor 22 leads from the sump pit to a remote connection to a source of electrical power, and the check vent 29 is connected either at the sealing plug 17 or at a remote location through the venting tube 26. The discharge pipe 21 is connected to a discharge conduit (not shown) to discharge the pumped liquid at a desired remote location.

The apparatus 11 may be controlled manually or automatically through the use of liquid level sensors. In either case, and with the liquid at level $L_e$ as shown in FIG. 2, the level of liquid within canister 12 will be at the same level as outside the canister 12 when the apparatus 11 is not operating. Before the pumping means 18 can begin, the external liquid level $L_e$ must be at least as high as the pump inlet 18*a* (internal liquid level $L_1$ as shown) in order for the pump to draw liquid. When the electrical pumping motor 19 is actuated at such time to drive pump 18, a vacuum is drawn within the canister 12 and liquid is drawn into the pump inlet 18*a* and pumped away. The internal liquid level $L_1$ is maintained at the inlet 18*a* due to the pressure differential between atmospheric pressure acting on the liquid at level $L_e$ and the partial vacuum created within canister 12. This occurs even though the external level $L_e$ drops below the inlet 18*a*. The external level $L_e$ will continue to be lowered by the pumping action until it reaches the uppermost perforations 15*a*. At this point, the pumping means 18 begins to draw air and its operation is stopped.

With the pumping means 18 in an inoperative state, the internal liquid level $L_1$ will rise within canister 12 as the external level $L_e$ begins to rise. As this occurs, air trapped within the canister 12 is compressed. If such air were allowed to remain trapped, air pressure would ultimately become sufficiently high as to prevent the internal liquid level $L_1$ from rising to the pump inlet 18*a*, and apparatus 11 could not work. However, the provision of the venting tube 26 and check valve 29 allows this air to escape, thus insuring that the internal liquid level $L_1$ can rise to the level of pump inlet 18*a* for proper operation.

It will also be appreciated that, if the external liquid level $L_e$ is above the pump inlet 18*a*, the internal liquid level $L_1$ will be at the same level until the apparatus 11 reduces the external level $L_e$ to a point below the pump inlet 18*a*, and the internal liquid level $L_1$ remains at the level of pump inlet 18*a*.

Based on the pressure differential between atmospheric pressure acting on the outside apparatus 11 and the partial vacuum existing within the canister due to pumping means 13, the internal liquid level $L_1$ will remain as shown in FIG. 2 until the external liquid level $L_e$ reaches the uppermost perforations 15*a*. At this point, liquid can no longer be drawn into the pump and level $L_1$ drops to level $L_e$. The pump may be turned off manually at this point in time, or a sensor may accomplish automatic shut off.

Even though the inlet 18*a* is at a midpoint of the apparatus 11, sealing the upper end of canister 12 and placing the liquid inlet at the lower end of canister 12 enables the apparatus 11 to pump out liquid down to a level just above the bottom B of the sump pit.

Figure 4:
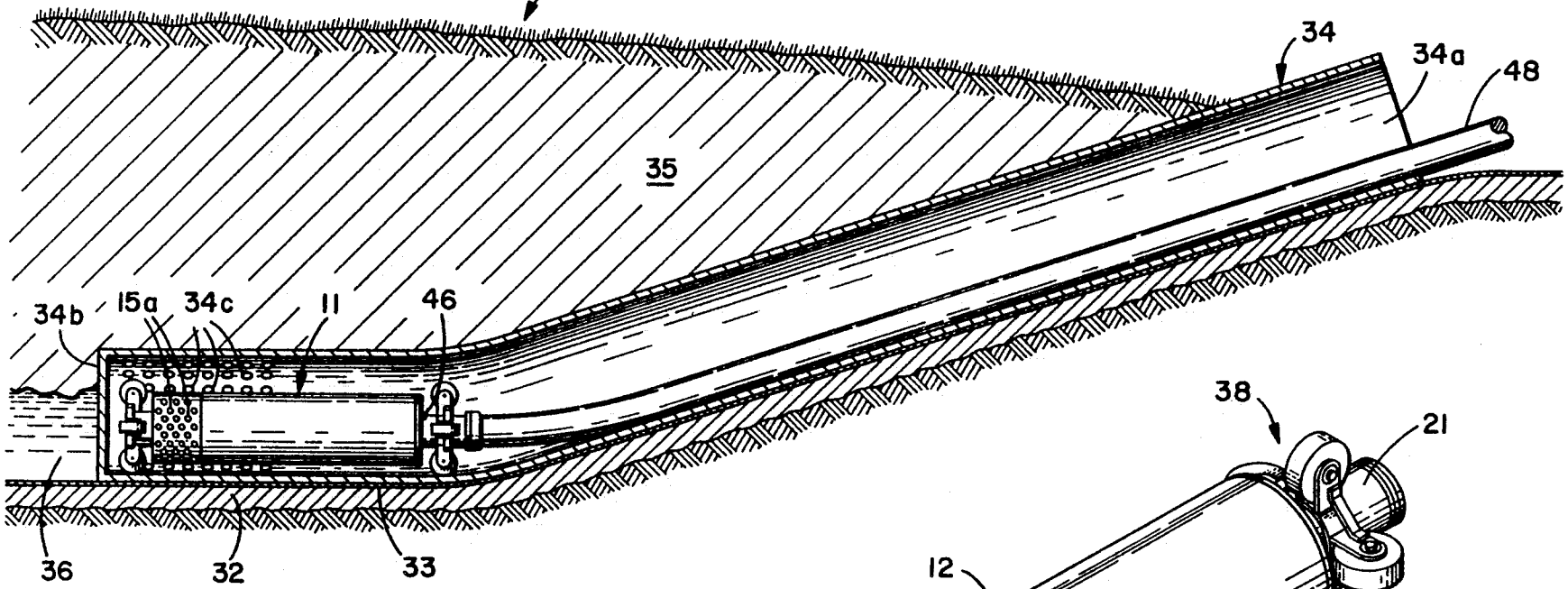
FIG. 4 is a cross-sectional and disproportionate view of a conventional landfill having a side slope riser conduit, with an alternative embodiment of the sump draining apparatus installed in the riser conduit.
Figure 5:
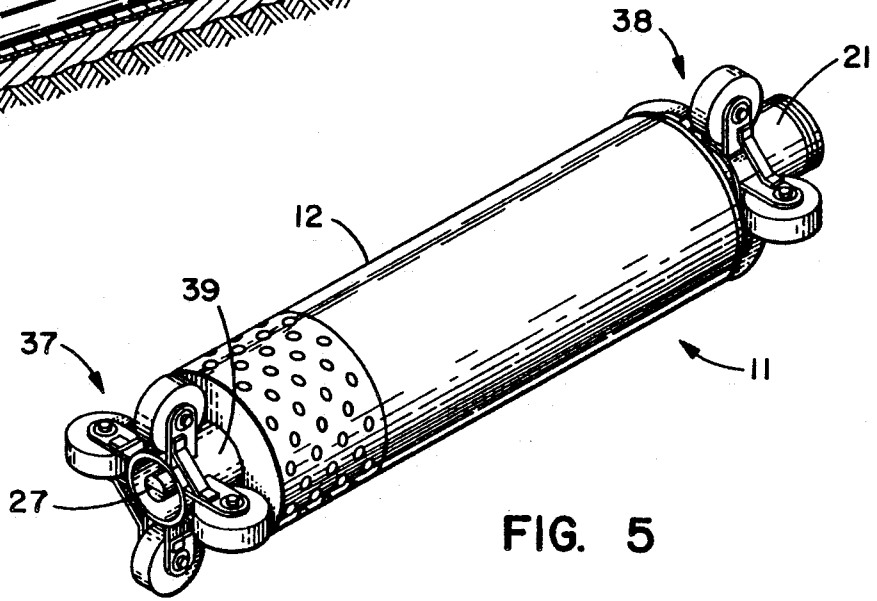
FIG. 5 is an enlarged perspective view of the alternative sump draining apparatus shown in FIG. 4.

FIGS. 4 and 5 disclose a modification to the sump draining apparatus permitting its use in a landfill having a side slope riser conduit. In these Figures, the same reference numerals used in FIGS. 1–3 are used for identical components, and different reference numerals are used for different structural components.

With reference to FIGS. 4, a landfill is represented generally by the letter L. The landfill takes the form of a land basin, either natural or man made, having a bottom defined by a layer of clay or a similar material. As shown in FIG. 4, the bottom surface of the landfill L is essentially horizontal, but slopes gradually upward, typically at a slope of 3/1, to the external ground surface. An impermeable liner 33 is placed over the clay bed 32 and thus covers the entire bottom surface of the landfill L.

A side slope riser conduit is represented generally by the numeral 34. For purposes of clarity, the riser conduit 34 and the sump draining apparatus and its attachments (described below) are shown disproportionately large relative to the landfill. The landfill may include a plurality of riser conduits 34 depending on the size.

Riser conduit 34 generally takes the form of a plastic pipe that may vary from six inches to two feet in diameter, depending on the size of the landfill L and other parameters. The riser conduit 34 has an open upper end 34*a*, and its extends downwardly along the side slope surface defining the bottom of landfill L. As the riser conduit reaches the extreme bottom of landfill L, it bends horizontally as shown. The extreme lower end 34*b* of conduit 3 is closed, bu the circumferential wall adjacent the end 34*b* is formed a plurality of perforations 34*c*.

Landfill L is filled with refuse and waste material indicated by reference numeral 35. As shown in FIG. 4, landfill L is completely filled and may be covered with soil and grass for aesthetic purposes as shown. The refuse and waste material may be liquid in part, which eventually finds its way to the bottom of the landfill. In addition, rain falling on the landfill L also seeps through the refuse and waste material 35, also accumulating at the landfill bottom, and is represented by reference numeral 36. The waste liquid 36 is admitted to the riser conduit 34 through perforations 34*c* to be removed by sump draining apparatus 11.

Sump draining apparatus 11 is for the most part identical to the sump draining apparatus shown in FIGS. 1–3. The principal structure difference is that the apparatus 11 shown in FIGS. 4 and 5 includes wheel means 37, 38 respectively secured to its opposite ends.

More specifically, and with reference to FIG. 5, a short metal sleeve or tube 39 is welded to the closed bottom end of canister 12 in coaxial relation therewith. With additional reference to FIGS. 6 and 7 (which is exemplary of both wheel assemblies 37 and 38), a plurality of wheel mounting brackets 41 are arranged in spaced pairs circumferentially around the sleeve 39. Each of the brackets 41 takes the form of a tab or ear having a straight bottom edge 41*a* that can be welded to the sleeve 39, a rounded upper end 41*b* and an aperture 41*c*. The apertures 41*c* of a spaced pair are disposed in registration to receive a small axle member 42 that rotationally carries a wheel member 43. Snap washers 44 snap into slots formed in the axle 42 to retain the axle 42 and wheel 43 in place. A plurality of angle supports 45 are welded between adjacent pairs of brackets 41 to stabilize the wheel assembly 37.

A pressure transducer 27 taking the form of a strain gauge is secured within the sleeve 39. Pressure transducer 27 is disposed on the longitudinal axis of canister 12 so that, whatever the rotational orientation of sump draining apparatus 11, it will remain in the same relative position to accurately sense and indicate the presence of absence of liquid.

Wheel assembly 38 is identical in construction, except that the wheel support brackets 41 are welded directly to the discharge pipe 21. In addition, and with reference to FIGS. 4 and 6, U-shaped members 46 are welded to the end plug 17 in diametric opposition to provide hooks to which a cable or rope may be tied to lower the apparatus 11.

Figure 6:
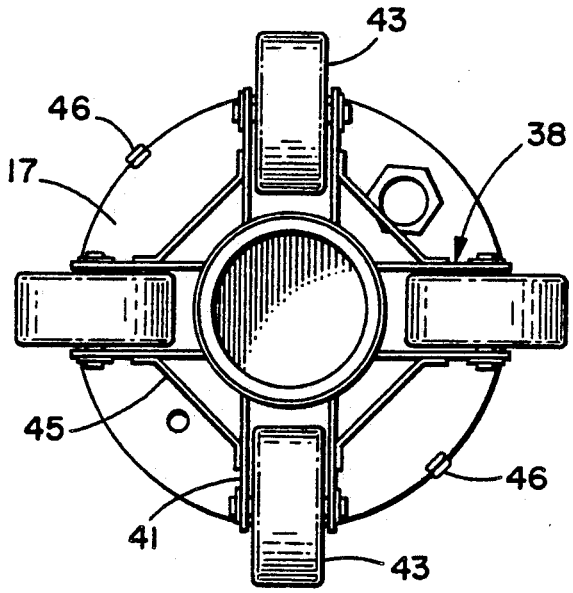
FIG. 6 is an end view of the sump draining apparatus of FIGS. 4 and 5, showing in particular a wheel configuration for effecting its longitudinal movement.
Figure 7:
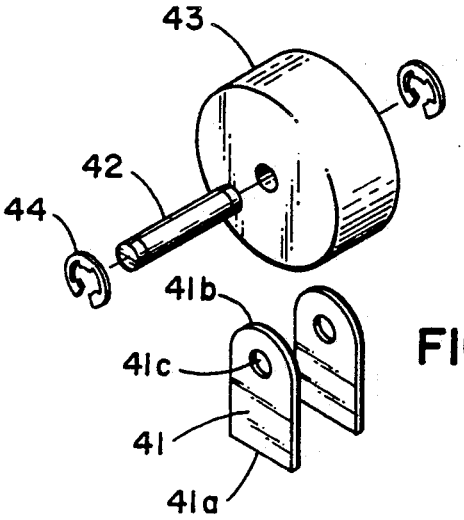
FIG. 7 is an enlarged exploded perspective of the construction of a wheel and its support.

With particular reference to FIG. 6, it will be noted that the wheel assembly 38 (and the wheel assembly 37 as well) includes a plurality of wheel members 43, each of which defines a rolling surface disposed radially or laterally beyond the external surface of the canister 12. These rolling surfaces are circumferentially arranged and preferably equidistantly spaced so that, whatever the rotational orientation of the apparatus 11 within riser conduit 34, two or more of the wheels 43 of each wheel assembly 37, 38 will engage the conduit 34 and enable the apparatus 11 to roll smoothly.

Figure 8:
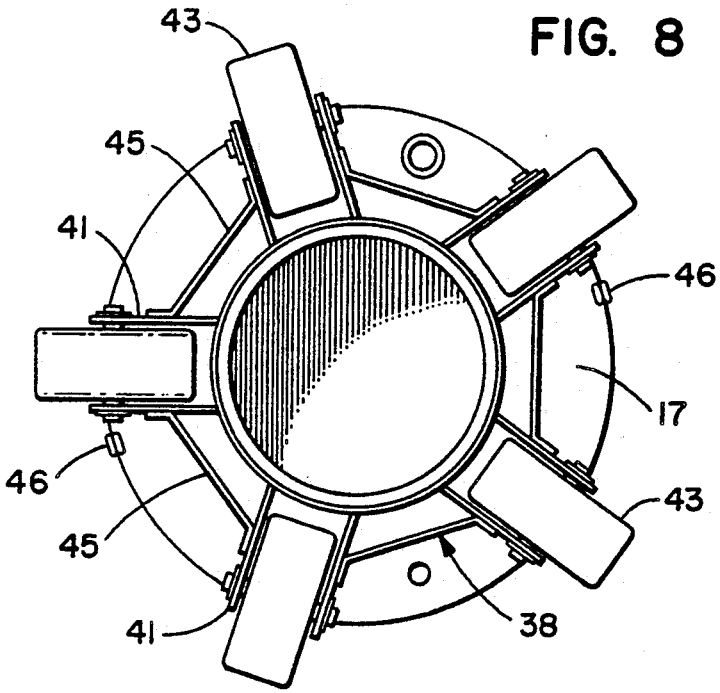
FIG. 8 is an alternative wheel configuration for the sump draining apparatus.

With reference to FIG. 8, for a riser conduit 34 having a greater diameter, the wheel assemblies at each end of the apparatus 11 may include five equiangularly spaced wheel members 43 to ensure rolling engagement with at least two wheel members at all times.

While specific wheel assembly configurations have been disclosed, it will be appreciated that other types of rolling assemblies are possible, so long as the rolling surfaces project laterally or radially beyond the external surface of the apparatus 11.

With reference to FIG. 4, the wheeled sump draining apparatus 11 is generally installed after the side slope riser conduit 34 is in place. To install the apparatus 11, ropes or cables are secured to the U-shaped members 46, and a flexible discharge hose or tube is secured to the discharge outlet 21 of the apparatus 11. The apparatus 11 is then lowered into the riser conduit 34, where it rolls longitudinally downward by gravity. The wheel assemblies 37, 38 support the apparatus 11 at each end and ensure rolling engagement of at least two of the wheel members 46 at each end to provide free rolling movement.

It will be observed that the diameter of the riser conduit is greater than the diameter of canister 12 and also greater than the effective diameter of the wheel assemblies 37, 38. As such, there is ample clearance between the sump draining apparatus 11 and the side walls of the riser conduit 34. This size relationship as well as the length of sump draining apparatus 11 are chosen so that the apparatus 11 will not become lodged at the bend of the riser conduit 34. As such, and although the slope of riser conduit 34 may be relatively shallow, the sump draining apparatus 11 will roll easily throughout its length, through the bend and into engagement with the closed end **34*b*. The electric motor conduit and vent tubing (reference numbers 22 and 26 in FIG. 2) are not shown in FIG. 4, but also lead from the apparatus 11 through the length of riser conduit 34 to a point outside the landfill. In addition, an electric conductor (not shown) may also lead from the pressure transducer 27 to a point outside the landfill L for connection to automatic controlling apparatus that turns the pump motor on and off as a function of pressure sensed at the inlet end of the sump draining apparatus 11**.

As such, and when the level of liquid 36 increases to the point of contact with the transducer 27, the pump motor 19 is turned on. Liquid enters the perforations **15*a* of canister 12 until it reaches the pump inlet 18*a*, at which time it is pumped through the discharge outlet 21 and flexible hose 48. When the level of liquid 36 fails below the pressure transducer 27, the pump motor 19** stops.

The wheel sump draining apparatus 11 is thus easily installed, operates efficiently to remove leachate buildup at the bottom of landfill L, and may also be removed easily for service or repair.

What is claimed is:

1. Sump draining apparatus intended for use in a landfill or the like having a side slope riser conduit of predetermined cross-sectional size extending from a first point outside the landfill to a second point proximate the landfill bottom, the sump draining apparatus comprising:

a body member having first and second ends and a cross-sectional size less than that of the side slope riser conduit and defining an external surface, the body member having a fluid inlet proximate the first end for receiving fluid and a fluid outlet proximate to the second end through which fluid maybe discharged, the outlet being adapted for connection to a fluid conduit that extends at least to the first point of said side slope riser conduit;

pumping means within the body member for pumping fluid received from the inlet to said outlet; and wheel means carried by the body member and defining a plurality of rolling surfaces each of which projects laterally beyond said external surface, whereby the sump draining apparatus may longitudinally roll over the length of the side slope riser conduit to the lower end thereof.

2. The apparatus defined by claim 1, wherein the body member is elongated in shape.

3. The apparatus defined by claim 2, wherein the wheel means comprises a wheel assembly disposed at each end at the body member, each wheel assembly comprising a plurality of wheel members and support means secured to the body member for rotationally carrying the wheel members.

4. The apparatus defined by claim 3, wherein the support means comprises a plurality of pairs of wheel supporting members disposed in space relation and wheel axle means transversely carried between each pair of wheel supporting members, a wheel member being carried by the axle means between each pair of wheel supporting members.

5. The apparatus defined by claim 3, wherein the wheel assembly comprises four wheel members.

6. The apparatus defined by claim 3, wherein the wheel assembly comprises five wheel members.

7. The apparatus defined by claim 5 or 6, wherein the wheel members are circumferentially arranged and equiangularly spaced.

8. The apparatus defined by claim 1, which further comprises transducer means disposed proximate the first and of the body member for sensing the presence of liquid at said inlet.

9. The apparatus defined by claim 8, wherein the body member is elongated in shape and has a predetermined longitudinal axis, and the transducer means is disposed on said axis.

10. Sump draining apparatus for use in a landfill or the like, having a side slope riser conduit of circular configuration and predetermined internal diameter, the riser conduit extending from a first point outside the landfill to a second point proximate the landfill bottom, the sump draining apparatus comprising:

an elongated tubular body having first and second ends and being of predetermined cross-sectional size which is less than the diameter of the riser conduit to permit its longitudinal movement therethorugh;

the tubular body having a fluid inlet proximate the first end for receiving fluid, a fluid outlet proximate the second end through which fluid may be exhausted, the outlet being adapted for connection to a fluid conduit that extends at least to the first point of the riser conduit;

pumping means within said tubular body for pumping fluid received from the inlet to said outlet;

first and second wheel means disclosed proximate the first and second ends of the tubular body, respectively, each of said wheel means defining a plurality of rolling surfaces each of which is disposed radially beyond the external surface of the tubular body, the rolling surfaces of each of the first and second wheel means being disposed circumferentially around the tubular body to permit the body to roll longitudinally through the riser conduit notwithstanding its rotational orientation.

11. The apparatus defined by claim 10, wherein the rolling surfaces are equi-angularly spaced.

* * * * *